US010358948B2

(12) United States Patent
Tsuboi et al.

(10) Patent No.: US 10,358,948 B2
(45) Date of Patent: Jul. 23, 2019

(54) THERMAL ENERGY RECOVERY DEVICE

(71) Applicant: Kobe Steel, Ltd., Hyogo (JP)

(72) Inventors: Noboru Tsuboi, Hyogo (JP); Shigeto Adachi, Takasago (JP)

(73) Assignee: Kobe Steel, Ltd., Hyogo (JP)

( * ) Notice: Subject to any disclaimer, the term of this patent is extended or adjusted under 35 U.S.C. 154(b) by 0 days.

(21) Appl. No.: 15/927,540

(22) Filed: Mar. 21, 2018

(65) Prior Publication Data

US 2018/0274392 A1 Sep. 27, 2018

(30) Foreign Application Priority Data

Mar. 22, 2017 (JP) ..... 2017-055378

(51) Int. Cl.
*F01K 25/06* (2006.01)
*F01D 17/04* (2006.01)
(Continued)

(52) U.S. Cl.
CPC ..... *F01K 25/06* (2013.01); *F01D 15/10* (2013.01); *F01D 17/00* (2013.01); *F01D 17/02* (2013.01);
(Continued)

(58) Field of Classification Search
CPC ..... F01K 25/06; F01K 25/08; F01K 23/065; F01D 17/04; F01D 17/02; F01D 17/00;
(Continued)

(56) References Cited

U.S. PATENT DOCUMENTS 4,029,951 A * 6/1977 Berry ..... F01D 19/02 700/289
4,267,458 A * 5/1981 Uram ..... F01D 17/24 290/40 R
(Continued)

FOREIGN PATENT DOCUMENTS

JP 2014-114785 A 6/2014
JP 2014-234719 A 12/2014

OTHER PUBLICATIONS

The extended European search report issued by the European Patent Office dated Sep. 10, 2018, which corresponds to European Patent Application No. 18161674.9-1008 and is related to U.S. Appl. No. 15/927,540.

*Primary Examiner* — Hoang M Nguyen
(74) *Attorney, Agent, or Firm* — Studebaker & Brackett PC

(57) ABSTRACT

A thermal energy recovery device (1) includes a circulation passage (4) having an evaporator (10), an expander (14), a condenser (6), and pump (8), and a controller (18) controlling the rotational number of the pump (8). The expander (14) is driven upon introduction of a mixed medium of a working medium evaporated in the evaporator (10) and oil into the expander (14). The controller (18) can execute a thermal load control for controlling the rotational number of the pump (8) according to a thermal load in the evaporator (10) and an oil return control for driving the pump (8) at the rotational number higher than that of the pump (8) controlled by the thermal load control. The oil return control is executed if a preset oil accumulation condition regarding an accumulation degree of the oil that is separated from the working medium evaporated in the evaporator (10) is satisfied.

12 Claims, 8 Drawing Sheets

(51) Int. Cl.

| | |
|---|---|
| ***F01K 23/06*** | (2006.01) |
| ***F01D 25/18*** | (2006.01) |
| ***F02G 5/02*** | (2006.01) |
| ***F01D 15/10*** | (2006.01) |
| ***F01N 5/02*** | (2006.01) |
| ***F01D 17/00*** | (2006.01) |
| ***F01D 17/02*** | (2006.01) |
| ***F01K 25/08*** | (2006.01) |

(52) U.S. Cl.
CPC ..... *F01D 17/04* (2013.01); *F01D 25/18* (2013.01); *F01K 23/065* (2013.01); *F01K 25/08* (2013.01); *F01N 5/02* (2013.01); *F02G 5/02* (2013.01)

(58) Field of Classification Search
CPC . F01D 25/18; F01D 15/10; F01N 5/02; F02G 5/02
USPC ..... 60/646, 657, 660–667
See application file for complete search history.

(56) References Cited

U.S. PATENT DOCUMENTS

| | | | | |
|---|---|---|---|---|
| 2010/0034684 | A1 | 2/2010 | Ast et al. | |
| 2014/0159369 | A1 | 6/2014 | Tsuboi et al. | |
| 2014/0250886 | A1* | 9/2014 | Mizoguchi ..... | F01K 23/10 60/663 |
| 2014/0356208 | A1 | 12/2014 | Tsuboi | |
| 2015/0275699 | A1* | 10/2015 | Waibel ..... | F01K 7/165 60/615 |
| 2017/0016353 | A1* | 1/2017 | Takahashi ..... | F01K 13/02 |

* cited by examiner

THERMAL ENERGY RECOVERY DEVICE

BACKGROUND OF THE INVENTION

Field of the Invention

The present invention related to a thermal energy recovery device.

Description of the Related Art

Hitherto, a thermal energy recovery device powered by recovering exhaust heat is known as disclosed in JP 2014-114785 A and JP 2014-234719 A. The thermal energy recovery devices disclosed in JP 2014-114785 A and JP 2014-234719 A are each provided with a circulation passage having an evaporator, an expander, a condenser, and a pump. In the thermal energy recovery devices, a working medium (a cooling medium) is evaporated by exhaust heat from the outside in the evaporator and steam of the working medium is used for rotatably driving a rotor in the expander. The rotation of the rotor in the expander drives a generator.

The expander uses oil for lubricating a bearing for rotatably supporting the rotor and for sealing each part in the expander. The oil flows in the circulation passage by being dissolved in the working medium in a liquid state or by being accompanied with the working medium in a gaseous state. In the evaporator, the oil dissolved in the working medium is separated from the working medium due to the evaporation of the working medium. The oil separated from the working medium flows in a lubrication passage while being accompanied with the working medium to return to the expander.

In the case where heat of exhaust gas of a vehicle, for example, is used as a heat source, as is the case in the thermal energy recovery device disclosed in JP 2014-234719 A, a heat load in the evaporator fluctuates. The rotational number of the pump for circulating the working medium can be controlled to adjust, for example, a superheating degree in the evaporator to a target value. In such a configuration, if the amount of heat source gas flowing in the evaporator is reduced, the amount of the working medium sent to the evaporator decreases, making it difficult for the oil separated from the evaporated working medium to be accompanied with the working medium. As a result, the oil is accumulated, for example, in an upper part of the evaporator and rarely returned to the expander. This may cause an insufficient oil supply to an oil supply part in the expander.

Hence, the present invention has been made in view of the above-described conventional art and has the purpose of facilitating the return of the oil to the expander even if the heat load in the evaporator is reduced.

SUMMARY OF THE INVENTION

In order to achieve the above-mentioned purpose, the present invention provides a thermal energy recovery device including a circulation passage having an evaporator, an expander, a condenser, and a pump, and a controller for controlling the rotational number of the pump. In the thermal energy recovery device, a mixed medium of a working medium evaporated in the evaporator and oil is introduced in the expander to drive the expander. The controller can execute a thermal load control for controlling the rotational number of the pump according to a thermal load in the evaporator and an oil return control for driving the pump at the rotational number higher than the rotational number of the pump controlled by the thermal load control. The oil return control is executed if a preset oil accumulation condition regarding an accumulation degree of the oil that is separated from the working medium evaporated in the evaporator or a preset low load condition regarding a low load of a prescribed value or less in the evaporator is satisfied.

In the present invention, if the preset oil accumulation condition or low load condition is satisfied, a switching from the thermal load control to the oil return control occurs. That is, the oil return control is executed in preference to the thermal load control in the case where the oil is accumulated on an upstream side of an expansion chamber in the expander due to a large fluctuation of the thermal load, the oil is accumulated on the upstream side of the expansion chamber in the expander regardless of the fluctuation of the thermal load, or the evaporator remains in a condition of having a low thermal load. With such an operation, the rotational number of the pump is made larger than that set according to the thermal load in the evaporator. As a result, a flow velocity of the working medium in the evaporator becomes high, making it easy for the oil separated from the evaporated working medium to be accompanied with the working medium. Thus, the oil can be easily returned from an upstream side of the expander to an inside of the expander, thereby enabling to prevent the occurrence of an insufficient oil supply to an oil supply part in the expander.

The accumulation degree of the oil used in the oil accumulation condition may be an accumulation degree of the oil in a connection space. The connection space may include a downstream space, in the evaporator, arranged on a downstream side of a heat exchanging portion in the evaporator, an inflow passage positioned on an upstream side of a supply port in the expander, and a main passage that is communicated with the downstream space and the inflow passage to connect the evaporator and the expander.

In such a configuration, the oil is sometimes accumulated in the downstream space in the evaporator if the thermal load in the evaporator becomes a partial load. When the oil return control is executed by the controller, the oil in the downstream space is returned to an expander side via the main passage. That is, the thermal energy recovery device can be prevented from being made complicated.

The connection space may include an oil reservoir that is communicated with a connection port of the main passage and the inflow passage in the expander and positioned below the inflow passage.

In such a configuration, the expander is provided in its inside with the oil reservoir that is communicated with the connection port of the main passage and the inflow passage and positioned below the inflow passage, thereby enabling to prolong a period from the start of a partial load operation to a time when the insufficient oil supply to the oil supply part in the expander occurs.

The inflow passage may be provided along an axial direction of the expander from the connection port of the main passage toward the supply port in the expander. In such a case, the connection space may include the oil reservoir that is communicated with the connection port of the main passage and the inflow passage in the expander and positioned below the inflow passage.

Having such a configuration makes it easy for the oil in the oil reservoir to be accompanied with a flow of the working medium flowing from the connection port of the main passage toward the supply port in the expander.

The thermal energy recovery device may include an oil detector for detecting an accumulation degree of the oil in the connection space. In such a case, the controller may be configured to switch the thermal load control to the oil return control if the oil accumulation condition is satisfied on the basis of a detection result of the oil detector.

In such a configuration, the oil detector can directly detect the accumulation degree of the oil on an upstream side of an expansion chamber in the expander. Thus, this configuration can minimize a period in which the rotational number of the pump is increased, for example, in the case where the thermal load in the evaporator is low, or the like.

The thermal energy recovery device may include the oil detector for detecting the oil accumulated in the oil reservoir. In such a case, the controller may be configured to switch the thermal load control to the oil return control if an amount of the oil accumulated in the oil reservoir detected by the oil detector becomes a prescribed level or less.

In such a configuration, the oil return control is performed on the basis of the accumulation degree of the oil in the oil reservoir communicated with the inflow passage positioned on the upstream side of the supply port in the expander, thus the insufficient oil supply to the oil supply part in the expander can be more surely prevented.

The thermal energy recovery device may include a thermal load condition detection means for directly or indirectly detecting a condition of the thermal load in the evaporator and a timing means for counting a time for which the thermal load detected by the thermal load detection means remains a partial load of a prescribed value or less. In such a case, the controller may be configured to switch the thermal load control to the oil return control if the time counted by the timing means reaches or exceeds a prescribed time on an assumption that the low load condition is satisfied.

In such a configuration, the thermal load control can be switched to the oil return control without detecting the accumulation degree of the oil. That is, the switching to the oil return control can be surely performed by a relatively simple configuration (a detector and a software) even if a large wave is formed on the oil surface in an oil accumulation place.

The oil supply part in the expander may be communicated with the supply port and an exhaust port in the expander. In such a case, a pressure in the oil supply part may be between a pressure at the supply port in the expander and a pressure at the exhaust port in the expander.

In such a configuration, the oil supply part is communicated not only with the supply port but also with the exhaust port. Further, the pressure in the oil supply part is between the pressure at the supply port and the pressure at the exhaust port. Thus, the oil passing through the supply port flows in the oil supply part by a pressure difference. That is, an internal oil supply path for supplying the oil to the oil supply part is formed inside the expander. Thus, if the oil supply part is positioned on a downstream side of the supply port, the oil can be supplied to the oil supply part without having an (external) oil supply pipe for drawing out the oil accumulated in the oil reservoir from the oil reservoir (to the outside) and supplying the oil to the oil supply part in the expander. This can reduce the number of pipe connection portions in the expander and improve the reliability against oil leakage.

The expander may include screw rotors and bearings rotatably supporting shafts of the screw rotors. In such a case, the bearings may be the oil supply parts.

Having such a configuration can prevent the insufficient oil supply to the bearings and improve the reliability of the expander.

Further, performing the oil return control can prevent a situation in which the oil is not returned to the expander. This can prevent a situation in which an oil passage is not sealed by the oil flowing therein after lubricating the bearings. Thus, the occurrence of a short pass (a bypass) of steam through the oil passage can be prevented. As a result, a reduction in the thermal energy recovery efficiency can be prevented.

The evaporator may include a heat exchanging portion and a downstream space positioned on a downstream side of the heat exchanging portion, and the circulation passage may include a main passage that connects the evaporator and the expander. In such a case, an oil returning pipe having one end connected to the downstream space in the evaporator at a location below a connection portion to the main passage and the other end connected to the expander may be included.

Having such a configuration enables to effectively return the oil accumulated in the downstream space to the expander via the oil returning pipe.

The oil returning pipe may be thinner than the main passage.

Having such a configuration increases a flow velocity of the mixed medium in the oil returning pipe, thus the oil can be easily accompanied with the flow of the working medium.

A primary side passage of the heat exchanging portion in the evaporator may be connected to a cooling water passage in which cooling water for cooling an engine in a vehicle with engine flows.

An engine load in the vehicle with engine fluctuates. This causes a fluctuation in at least one of a temperature and a flow rate of the cooling water flowing in the primary side passage of the heat exchanging portion in the evaporator. As a result, the thermal load in the evaporator fluctuates. In such a case, a reduction in the thermal load in the evaporator may cause a situation where the oil is not returned to the expander. However, the controller executes the oil return control if the oil accumulation condition or the low load condition is satisfied, thereby enabling to prevent the occurrence of the insufficient oil supply to the oil supply part in the expander.

As described above, according to the present invention, it becomes possible to facilitate the return of the oil to the expander even if the thermal load in the evaporator decreases.

DESCRIPTION OF THE PREFERRED EMBODIMENTS

Hereinafter, embodiments of the present invention are described in detail with reference to the drawings.

First Embodiment

Figure 1:
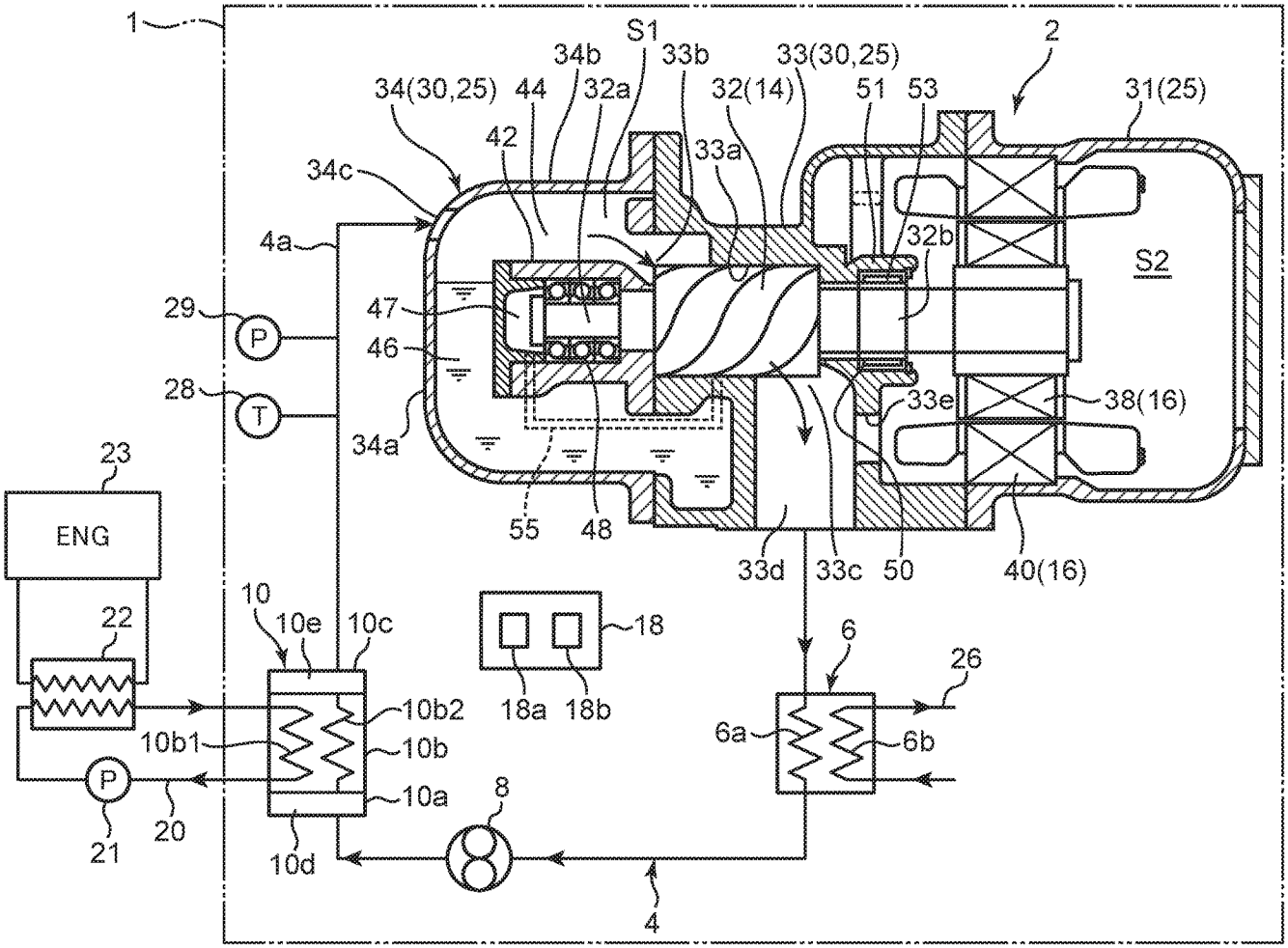
FIG. 1 is a schematic view illustrating an overall configuration of a thermal energy recovery device according to a first embodiment of the present invention.

A thermal energy recovery device 1 according to a first embodiment is configured as a power generation system for generating power by recovering thermal energy generated in a vehicle with engine. As shown in FIG. 1, the thermal energy recovery device 1 includes a pump 8, an evaporator 10, an expander 14, a generator 16, a condenser 6, and a controller 18. The pump 8, the evaporator 10, the expander 14, and the condenser 6 are provided to a circulation passage 4 in this order. A working medium and oil are sealed in the circulation passage 4. As the working medium, a refrigerant having a low boiling point, for example, R245fa (1,1,1,3,3-pentafluoropropane) or the like is used. Thus, the present power generation system is formed as a binary power generation system that recovers the power from engine exhaust heat of relatively low temperature. Further, the circulation passage 4 having the pump 8, the evaporator 10, the expander 14, and the condenser 6 constitutes a Rankine cycle. The oil is used for lubricating bearings described below in the expander 14 or sealing each part in the expander 14.

The pump 8 is provided to the circulation passage 4 on a downstream side of the condenser 6 (between the evaporator 10 and the condenser 6) and used to generate a circulation driving force of the working medium (specifically, a mixed medium containing the oil) in the circulation passage 4. The pump 8 pressurizes the working medium (specifically, the mixed medium containing the oil) in a liquid state, which is condensed in the condenser 6, to a prescribed pressure and sends it to the evaporator 10. As the pump 8, a centrifugal pump having an impeller as a rotor, a gear pump in which a pair of gears forms a rotor, or the like may be used.

Figure 2:
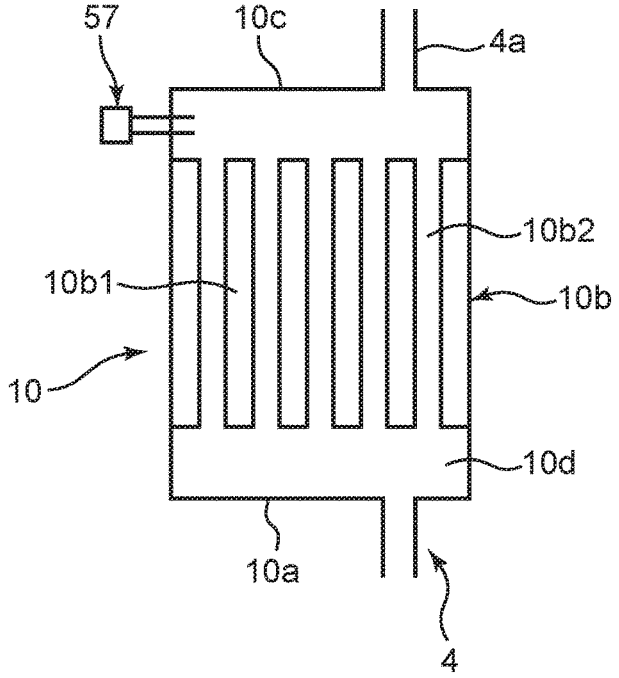
FIG. 2 is a diagram for explaining a configuration of an evaporator provided in the thermal energy recovery device.

The evaporator 10 is provided to the circulation passage 4 on a downstream side of the pump 8 (between the pump 8 and the expander 14). As shown in FIG. 2, the evaporator 10 includes an upstream side header 10*a*, a heat exchanging portion 10*b*, and a downstream side header 10*c*.

The upstream side header 10*a* is provided at a lower end of the evaporator 10. The upstream side header 10*a* includes an upstream space 10*d* in which the mixed medium of the working medium in a liquid state and the oil flows after being sent out from the pump 8.

The heat exchanging portion 10*b* includes a primary side passage 10*b*1 in which cooling water as a heating medium flows and a secondary side passage 10*b*2 in which the mixed medium flows, both of which being arranged on the upstream side header 10*a*. The primary side passage 10*b*1 is connected to a heating medium passage (a cooling water passage) 20. The heating medium passage 20 is provided with a heating medium pump 21 for circulating the heating medium. The heating medium flowing in the heating medium passage 20 is cooling water of which temperature is increased when the cooling water flows through a radiator 22 for cooling an engine. The radiator 22 cools an engine 23 by circulating a coolant between the radiator 22 and the engine 23. The working medium flowing in the secondary side passage 10*b*2 is evaporated by heat exchange with the heating medium flowing in the primary side passage 10*b*1.

Note that the heating medium is not limited to the cooling water flowing in the radiator 22 and may be cooling water or a coolant, which directly cools the engine 23. Further, the heating medium is not limited to the one used in a vehicle system mounted on a vehicle. For example, the heating medium may be exhaust gas of a ship engine mounted on a ship or steam used in a factory or the like.

A downstream side header 10*c* is provided on an upper side of the heat exchanging portion 10*b*. The downstream side header 10*c* includes a downstream space 10*e* in which the working medium evaporated in the secondary side passage 10*b*2 and the oil flow. The oil from which the working medium in a gaseous state was separated may be accumulated in the downstream space 10*e*.

The expander 14 and the generator 16 are integrally configured as a generator device 2. The generator device 2 extracts force for driving the generator 16 by expanding the working medium (mixed with the oil) in a gaseous state in the expander 14. Note that details of the generator device 2 are described later.

The working medium (specifically, the mixed medium also containing the oil) in a gaseous state is exhausted from the expander 14 and introduced into the condenser 6. The condenser 6 includes a primary side passage 6*a* in which the mixed medium flows and a secondary side passage 6*b* in which a cooling medium flows. The secondary side passage 6*b* is connected to an external medium passage 26 in which the cooling medium flows. The working medium in a gaseous state flowing in the primary side passage 6*a* is condensed by heat exchange with the cooling medium flowing in the secondary side passage 6*b*.

In the configuration described above, the power generation system according to the present embodiment is configured to form a circulation circuit in which the working medium sequentially flows through the evaporator 10, the generator device 2, the condenser 6, and the pump 8 in circulation passage 4.

A main passage 4*a* constitutes a part of the circulation passage 4 to fluidly connect between the evaporator 10 and the expander 14 and includes a temperature detector 28 for detecting a temperature of the working medium and a pressure detector 29 for detecting a pressure of the working medium.

Next, a configuration of the generator device 2 is described in detail.

The generator device 2 includes a casing 25 housing the expander 14 and the generator 16. The casing 25 includes a first case member 30 housing the expander 14 and a second case member 31 housing the generator 16, the second case member 31 being fastened to the first case member 30.

The first case member 30 includes a rotor retaining portion 33 for retaining screw rotors 32 described below in the expander 14, the rotor retaining portion 33 being fastened to the second case member 31, and a lid portion 34 fastened to the rotor retaining portion 33, the lid portion 34 being arranged on an opposite side to the second case member 31 with respect to the rotor retaining portion 33.

The lid portion 34 includes a bottom portion 34*a* and a cylindrical barrel portion 34*b* extending from an outer periphery of the bottom portion 34*a* to an axial direction of the screw rotors 32, thereby forming a bottomed substantially cylindrical shape. The casing 25 is arranged in such a manner that the bottom portion 34*a* is vertically arranged, and the screw rotors 32 and the barrel portion 34*b* are horizontally arranged along their axes.

The rotor retaining portion 33 is coupled to an end potion of the barrel portion 34*b*. In this manner, the lid portion 34 and the rotor retaining portion 33 form a sealed first space S1. The first space S1 is a high-pressure side space which contains the working medium having a pressure higher than that of the working medium in an expansion chamber and the oil.

The lid portion 34 (the first case member 30) is provided with an inflow port 34*c* penetrating the lid portion 34 in its thickness direction. The inflow port 34*c* is connected to one end of the main passage 4*a*, which constitutes a part of the circulation passage 4 to fluidly connect between the evaporator 10 and the expander 14. That is, the inflow port 34*c* is a connection port of the main passage 4*a*. The mixed medium in which the steam of the working medium generated in the evaporator 10 and the oil are mixed flows in the first space S1 from the main passage 4*a* via the inflow port 34*c*.

The rotor retaining portion 33 is coupled to the second case member 31 on a side opposite to the lid portion 34 in the axial direction of the rotor retaining portion 33. In this manner, the rotor retaining portion 33 and the second case member 31 form a sealed second space S2. As describe below, the second space S2 is a low-pressure side space through which the working medium having a pressure lower than that of the working medium in the expansion chamber and the oil pass.

The rotor retaining portion 33 includes a through hole 33*a* in which the screw rotors 32 are arranged, a supply port 33*b* that is communicated with the first space S1 as well as the expansion chamber when the expansion chamber is positioned on a first space S1 side, an exhaust port 33*c* that is communicated with the expansion chamber when the expansion chamber is positioned on a second space S2 side, an exhaust hole 33*d* that is communicated with the exhaust port 33*c* and opened to an outer surface of the rotor retaining portion 33, and a communication hole 33*e* that communicates the exhaust hole 33*d* with the second space S2.

The through hole 33*a* penetrates the rotor retaining portion 33 in the axial direction of the screw rotors 32. One end portion of the through hole 33*a* is opened on a surface of the rotor retaining portion 33 on the first space S1 side and the other end portion of the through hole 33*a* is opened on a surface of the rotor retaining portion 33 on the second space S2 side. The supply port 33*b* supplies the mixed medium of the working medium and the oil in the first space S1 into the expansion chamber. The exhaust port 33*c* exhausts the mixed medium of the working medium and the oil from the expansion chamber. The exhaust hole 33*d* is downwardly extended from the exhaust port 33*c*.

The mixed medium of the working medium in a gaseous state expanded in the expansion chamber and the oil is exhausted to the circulation passage 4 via the exhaust port 33*c* and the exhaust hole 33*d*. Further, as described below, a part of the oil flows from the expansion chamber to a second bearing 53 side. After lubricating the second bearing 53, the oil flows in the second space S2 and then flows in the exhaust hole 33*d* via the communication hole 33*e*.

The expander 14 includes a pair of the screw rotors 32 engaged with each other. The shaft of each screw rotor 32 has a first rotation shaft 32*a* extending from the screw rotor 32 to one side of the axial direction and a second rotation shaft 32*b* extending from the screw rotor 32 to the other side of the axial direction. The first rotation shafts 32*a* are located on a supply port 33*b* side and the second rotation shafts 32*b* are located on an exhaust port 33*c* side. The first rotation shafts 32*a* are extended into a first bearing retaining portion 42 described below. The second rotation shafts 32*b* are extended from the inside of the through hole 33*a* toward the inside of the second space S2.

Each screw rotor 32 has teeth of spiral shape. The teeth of both screw rotors 32 are engaged with each other to form the expansion chamber therebetween in the through hole 33*a*. When the screw rotors 32 rotate in a state in which the teeth of both screw rotors 32 are engaged with each other, the expansion chamber gradually moves from a position where the expansion chamber is communicated with the supply port 33*b* to the axial direction of the screw rotors 32. During this movement, a volume in the expansion chamber gradually increases. Then, the expansion chamber gradually moves to a positon where the expansion chamber is communicated with the exhaust port 33*c* by the rotation of the screw rotors 32.

The generator 16 includes a generator rotor 38 connected to the second rotation shaft 32*b* of one of the screw rotors 32 and a stator 40 arranged around the generator rotor 38. The stator 40 is fixed to an inside of the second case member 31. The generator rotor 38 and the stator 40 are arranged in the second space S2. The generator rotor 38 is connected coaxially to the one of the screw rotors 32 described above. The generator rotor 38 rotates integrally with the screw rotor 32. The generator 16 generates power by the rotation of the generator rotor 38.

The rotor retaining portion 33 is coupled to the first bearing retaining portion 42 for retaining first bearings 48 attached to the first rotation shafts 32*a*. The first bearing retaining portion 42 is arranged on the same side as the lid portion 34 with respect to the rotor retaining portion 33 in the axial direction of the screw rotors 32. The first bearing retaining portion 42 is coupled to the rotor retaining portion 33 inside a part where the rotor retaining portion 33 is coupled to the lid portion 34, and formed so as to extend in the axial direction of the screw rotors 32.

The first bearing retaining portion 42 is formed to be smaller than the lid portion 34 in a width direction and located at a position spaced inwardly from an inner surface of the lid portion 34. Thus, a space surrounded by inner surfaces of the bottom portion 34*a* and the barrel portion 34*b* of the lid portion 34 and an outer surface of the first bearing retaining portion 42 forms the first space S1 in which the mixed medium of the working medium and the oil flows.

The inflow port 34*c* formed on the lid portion 34 is located slightly higher than an upper end of the first bearing retaining portion 42. Then, the mixed medium introduced in the first space S1 via the inflow port 34*c* flows substantially straight from the inflow port 34*c* toward the supply port 33*b* in the axial direction of the screw rotors 32. That is, an inflow passage 44 extending from the inflow port 34*c* toward the supply port 33*b* in the expander 14 along an axial direction of the expander 14 is formed in the first space S1 in the expander 14. Further, the oil is accumulated in a space portion below the inflow passage 44 in the first space S1. Thus, this portion functions as an oil reservoir 46. Note that the inflow port 34*c* may be positioned slightly below the upper end of the first bearing retaining portion 42.

A first bearing chamber 47 partitioned from the first space S1 is formed in the first bearing retaining portion 42. The first bearing chamber 47 is communicated with the supply port 33*b* directly or via the expansion chamber at the supply port 33*b* side. The first bearing chamber 47 houses the first bearings 48 each arranged accordingly to the corresponding rotation shaft 32*a*. One of these first bearings 48 supports the first rotation shaft 32*a* of one of the screw rotors 32. The other first bearing 48 supports the first rotation shaft 32*a* of the other screw rotor 32. In other words, the first rotation shafts 32*a* are rotatably journaled by the first bearings 48.

The rotor retaining portion 33 is coupled to a second bearing retaining portion 51 that constitutes a second bearing chamber 50 communicated with the second space S2. The second bearing retaining portion 51 is arranged on the same side as the second case member 31 with respect to the rotor retaining portion 33 in the axial direction of the screw rotors 32. Note that, in the present embodiment, the second bearing retaining portion 51 and the rotor retaining portion 33 are integrally formed, however, these retaining portions 51 and 33 may be separately formed and fastened to each other.

The second bearing chamber 50 is communicated with the through hole 33*a* or the expansion chamber. The second bearing chamber 50 houses the second bearings 53 each arranged accordingly to the corresponding rotation shaft 32*b*. One of these second bearings 53 supports the second rotation shaft 32*b* of one of the screw rotors 32. The other second bearing 53 supports the second rotation shaft 32*b* of the other screw rotor 32. In other words, the second rotation shafts 32*b* are rotatably journaled by the second bearings 53.

An oil passage 55 is provided in the casing 25. The oil passage 55 is communicated with an inside of the first bearing chamber 47 and a part of the through hole 33*a* near the exhaust port 33*c*. Specifically, the part near the exhaust port 33*c* is a part shifted to a first bearing retaining portion 42 side by just about one tooth of the screw rotor 32 from a part where the screw rotor 32 makes a contact with the exhaust port 33*c*. One end of the oil passage 55 is connected to the internal space (the first bearing chamber 47) of the first bearing retaining portion 42 at a part located on a side opposite to the screw rotors 32 with respect to the first bearings 48. The other end of the oil passage 55 is connected to the rotor retaining portion 33 so as to communicate with the through hole 33*a* (the expansion chamber) near the exhaust port 33*c*. Note that the present embodiment is not limited to such a configuration and the other end of the oil passage 55 may be connected to the rotor retaining portion 33 so as to communicate with the exhaust hole 33*d*.

In the present embodiment, the oil in the first bearing chamber 47 flows in the expansion chamber via the oil passage 55. A part of the oil in the expansion chamber then flows from the through hole 33*a* into the second bearing chamber 50. Such an oil flow is generated by pressure differences between a pressure in the supply port 33*b*, a pressure in the first bearing chamber 47, a pressure in the expansion chamber, a pressure in the second space S2, and a pressure in the exhaust port 33*c*.

That is, as the working medium expands in the expansion chamber, the pressure in the expansion chamber gradually decreases from the supply port 33*b* side toward the exhaust port 33*c* side. The first bearing chamber 47 adjoins the expansion chamber on the supply port 33*b* side and is communicated with the expansion chamber near the exhaust port 33*c*. Thus, the pressure in the first bearing chamber 47 is lower than that in the supply port 33*b* and higher than that in the exhaust port 33*c*. On the other hand, the second bearing chamber 50 is communicated with the exhaust hole 33*d* via the second space S2 and the communication hole 33*e*, thus a pressure in the second bearing chamber 50 is lower than that in the expansion chamber on the exhaust port 33*c* side. Thus, the oil in the first bearing chamber 47 flows in the expansion chamber via the oil passage 55. Then, a part of the oil in the expansion chamber flows in the second bearing chamber 50. In other words, the pressures in the first bearing chamber 47 and the second bearing chamber 50 are between the pressure in the supply port 33*b* and the pressure in the exhaust port 33*c* (intermediate pressures). The oil contained in the mixed medium in the first space 51 is supplied to the first bearings 48 and the second bearings 53 by such a pressure relation. Since the oil is supplied to the first bearings 48 and the second bearings 53, the first bearings 48 and the second bearings 53 can be mentioned as oil supply parts in the expander 14. Supplying the oil to the bearings 48 and 53 can exert a lubrication effect on the bearings 48 and 53 and a sealing effect of preventing the leakage of the working medium from the retaining portions of the bearings 48 and 53.

The thermal energy recovery device 1 is provided with an oil detector 57 (see FIG. 2) for detecting an accumulation degree of the oil in a connection space from the downstream space 10*e* in the evaporator 10 to the supply port 33*b* in the expander 14. Specifically, in the first embodiment, the oil detector 57 is arranged in the downstream side header 10*c* in the evaporator 10 to detect the accumulation degree of the oil in the downstream space 10*e* in the evaporator 10.

The oil detector 57 may be configured to detect whether a prescribed amount of the oil is accumulated in the downstream space 10*e* or configured to detect an amount of the accumulated oil. The oil detector 57 shown in the figure has two detection ends and thus can detect an upper limit value and a lower limit value of an oil level. Note that the oil detector 57 may have only one detection end for detecting the lower limit value of the oil level. In such a case, it is only required that the oil return control described below is performed for a preset prescribed time.

The oil detector 57 outputs a signal corresponding to a detection result. The signal outputted from the oil detector 57 is inputted to the controller 18. Further, signals outputted from the temperature detector 28 and the pressure detector 29 are also inputted to the controller 18.

The controller 18 includes a storage portion, a temporary storage portion, an arithmetic portion, and the like and exerts prescribed functions by executing control programs stored in the storage portion. These functions include a superheat degree arithmetic portion 18*a* for deriving a superheat degree and a driving control portion 18*b* for controlling the rotational number of the pump 8.

The superheat degree arithmetic portion 18*a* derives the superheat degree of the working medium flowing in the main passage 4*a* on the basis of the signals from the temperature detector 28 and the pressure detector 29, using information associating a saturation vapor pressure and a temperature stored in the storage portion.

The driving control portion 18*b* can execute a thermal load control for controlling the rotational number of the pump 8 according to a thermal load in the evaporator 10 and an oil return control for driving the pump 8 at the rotational number higher than the rotational number of the pump 8 controlled by the thermal load control. The thermal load control adjusts the rotational number of the pump 8 (that is, a flow rate of the working medium sent to the evaporator) so that the superheat degree derived by the superheat degree arithmetic portion 18*a* falls within a target range. Specifically, if the flow rate of the heating medium flowing in the heat exchanging portion 10*b* in the evaporator 10 fluctuates, a heat quantity transferred from the heating medium to the working medium fluctuates, thus an evaporation amount of the working medium in the heat exchanging portion 10*b* fluctuates. For this reason, the thermal load control adjusts the rotational number of the pump 8 to introduce the working medium to the evaporator 10 according to the thermal load in the evaporator 10, thereby preventing a reduction in the thermal energy recovery efficiency in the expander 14.

In the case where the engine 23 performs a partial load operation and a state of low thermal load in the evaporator 10 continues, the oil is hardly returned from the evaporator 10 to the expander 14. In such a case, the oil return control is performed. The oil return control is executed if the preset oil accumulation condition regarding the accumulation degree of the oil that is separated from the working medium evaporated in the evaporator 10 is satisfied. That is, the controller 18 is configured to switch the thermal load control to the oil return control if the oil accumulation condition is satisfied on the basis of the detection result of the oil detector 57.

In the first embodiment, the oil accumulation condition is satisfied if the oil level detected by the oil detector 57 reaches the upper limit value. Thus, the oil return control is executed preferentially to the thermal load control if the level of the oil accumulated in the downstream space 10*e* reaches the upper limit value. The oil return control increases the rotational number of the pump 8 controlled by the thermal load control by a preset rotational number. This operation increases the flow rate and the flow velocity of the mixed medium sent from the pump 8 to the evaporator 10. This operation reduces the superheat degree of the working medium on the downstream side of the evaporator 10, however, the oil accumulated in the downstream space 10*e* is caused to flow in the main passage 4*a* by being accompanied with the working medium having a higher flow velocity. Thus, the oil in the downstream space 10*e* can be returned in the expander 14. Note that a part of the working medium may flow in the expander 14 in a liquid state. In such a case, the expander is preferably a displacement type expander, particularly preferably a screw expander having high liquid resistance.

The controller 18 is configured to switch the oil return control back to the thermal load control if the oil level detected by the oil detector 57 reaches the lower limit value.

Operations of the thermal energy recovery device 1 according to the present embodiment will now be described. When the pump 8 is driven, the mixed medium of the working medium in a liquid state and the oil sent from the pump 8 flows in the secondary side passage 10*b*2 via the upstream side header 10*a* in the evaporator 10. The working medium is heated and evaporated by the heating medium flowing in the primary side passage 10*b*1. When the working medium is evaporated, the oil contained in the mixed medium is separated from the working medium. A part of the oil that is separated from the working medium is sometimes accumulated in the downstream space 10*e*. The mixed medium of the working medium in a gaseous state evaporated in the evaporator 10 and the oil flows in the main passage 4*a* via the downstream space 10*e*. The mixed medium is introduced in the first space S1 via the inflow port 34*c* in the expander 14. In the first space S1, the mixed medium flows mainly in the inflow passage 44. During the flowing, if the oil is accumulated in the oil reservoir 46 in around an amount of soaking the first bearing retaining portion 42, a part of the oil that is accumulated in the oil reservoir 46 flows in the supply port 33*b* by being accompanied with the mixed medium.

The mixed medium in the first space S1 enters the expansion chamber via the supply port 33*b*. This causes the screw rotors 32 to rotate, leading to the rotation of the generator rotor 38 in the generator 16 to perform power generation. As the screw rotors 32 rotate, the expansion chamber moves in the axial direction of the screw rotors 32 to gradually expand the working medium. This gradually decreases the pressure of the working medium in the expansion chamber. The working medium is then exhausted to the circulation passage 4 via the exhaust port 33*c* and the exhaust hole 33*d*. The mixed medium of the working medium in a gaseous state and the oil is introduced in the primary side passage 6*a* in the condenser 6. The working medium is cooled and condensed by the cooling medium flowing in the secondary side passage 6*b* in the condenser 6. The working medium in a liquid state and the oil flow in the circulation passage 4 and are suctioned into the pump 8. Such a circulation is repeated in the circulation passage 4 to generate power in the generator device 2.

Apart of the oil contained in the mixed medium in the first space S1 flows from the supply port 33*b* or one end portion of the through hole 33*a* positioned on the supply port 33*b* side (the supply port 33*b* side of the expansion chamber) to the first bearing chamber 47. The part of the oil supplied to the first bearing chamber 47 flows in the expansion chamber near the exhaust port 33*c* via the oil passage 55. The oil in the expansion chamber flows in the exhaust hole 33*d* via the exhaust port 33*c* along with the expanded working medium.

Further, a part of the oil contained in the mixed medium in the first space S1 flows from the other end portion of the through hole 33*a* positioned on the exhaust port 33*c* side (the exhaust port 33*c* side of the expansion chamber) to the second bearing chamber 50. The part of the oil supplied to the second bearing chamber 50 flows in the exhaust hole 33*d* via the second space S2 and the communication hole 33*e*.

The controller 18 normally executes the thermal load control. Thus, the rotational number of the pump 8 is adjusted so that the superheat degree derived by the superheat degree arithmetic portion 18*a* falls within a target range. During this operation, if the level of the oil accumulated in the downstream space 10*e*, detected by the oil detector 57, reaches the upper limit value, the oil return control is executed. This operation accelerates the pump 8 to allow the oil accumulated in the downstream space 10*e* to be easily accompanied with the working medium and returned to the expander 14.

As described above, in the present first embodiment, if the preset oil accumulation condition is satisfied, the thermal load control is switched to the oil return control. That is, the oil return control is executed in preference to the thermal load control in the case where the oil is accumulated on the upstream side of the expansion chamber in the expander 14 due to the large fluctuation of the thermal load, the oil is accumulated on the upstream side of the expansion chamber in the expander 14 regardless of the fluctuation of the thermal load, or the evaporator 10 remains in a condition of having a low thermal load. This operation increases the rotational number of the pump 8 to be higher than that set according to the thermal load in the evaporator 10. As a result, the flow velocity of the working medium passing through the evaporator 10 increases, thus the oil separated from the evaporated working medium can be easily accompanied with the working medium. Thus, the oil can be easily returned from the upstream side of the expander 14 to the inside of the expander 14, making it possible to prevent the occurrence of the insufficient oil supply to the oil supply part in the expander 14.

Further, in the first embodiment, the oil return control is performed if the amount of the oil accumulated in the downstream space 10*e* in the evaporator 10 increases to a set range or more. Thus, the oil in the downstream space 10*e* flows in the expander 14 via the main passage 4*a* along with the working medium. As a result, the thermal energy recovery device can be prevented from being made complicated.

Further, in the first embodiment, the expander 14 is provided, in its inside, with the oil reservoir 46 that is communicated with the inflow port 34*c* functioning as the connection port of the main passage 4*a* and the inflow passage 44, and positioned below the inflow passage 44. This configuration can prolong a time period from the start of the partial load operation to a time when the insufficient oil supply to the oil supply part in the expander 14 occurs.

Further, in the first embodiment, the inflow passage 44 in the expander 14 is provided along the axial direction of the expander 14 from the inflow port 34*c* toward the supply port 33*b*. Thus, the oil accumulated in the oil reservoir 46 can be easily accompanied with the flow of the working medium flowing from the inflow port 34*c* toward the supply port 33*b*.

Further, in the first embodiment, the accumulation degree of the oil on the upstream side of the supply port 33*b* in the expander 14 can be directly detected by the oil detector 57. This can minimize a period for increasing the rotational number of the pump 8, for example, in the case where the thermal load in the evaporator 10 is low, or the like.

Further, in the first embodiment, the oil supply part is communicated not only with the supply port 33*b* but also with the exhaust port 33*c*. Further, the pressure in oil supply part is between the pressure in the supply port 33*b* and the pressure in the exhaust port 33*c* (the intermediate pressure). Thus, the oil passing through the supply port 33*b* flows in the oil supply part by a pressure difference. That is, an internal oil supply path for supplying the oil to the oil supply part is formed inside the expander 14. Thus, the oil supply part that is positioned on the downstream side of the supply port 33*b* can be supplied with the oil without having an external oil supply pipe for drawing out the oil accumulated in the oil reservoir 46 from the oil reservoir 46 to the outside and supplying the oil to the oil supply part in the expander 14. This can reduce the number of pipe connection portions in the expander 14 and improve the reliability against oil leakage.

Further, in the first embodiment, the oil supply parts include the bearings 48 and 53, and the oil is configured to flow from the supply port 33*b* to the bearings 48 and 53 by the pressure difference. Having such a configuration can prevent the insufficient oil supply to the bearings 48 and 53 and improve the reliability of the expander 14.

Further, performing the oil return control can prevent a situation in which the oil is not returned to the expander 14. This can prevent a situation in which the oil passage 55 is not sealed by the oil flowing therein after lubricating the bearings. Thus, the occurrence of a short pass (a bypass) of the working medium through the oil passage 55 can be prevented. As a result, a reduction in the thermal energy recovery efficiency can be prevented.

An engine load in a vehicle with engine fluctuates. This causes a fluctuation in at least one of a temperature and a flow rate of cooling water flowing in the primary side passage 10*b*1 of the heat exchanging portion 10*b* in the evaporator 10. As a result, the thermal load in the evaporator 10 fluctuates. In such a case, a reduction in the thermal load in the evaporator 10 may cause a situation where the oil is not returned to the expander 14. However, in the first embodiment, the controller 18 performs the oil return control if the oil accumulation condition is satisfied, thereby enabling to prevent the occurrence of the insufficient oil supply to the oil supply part in the expander 14.

Figure 3:
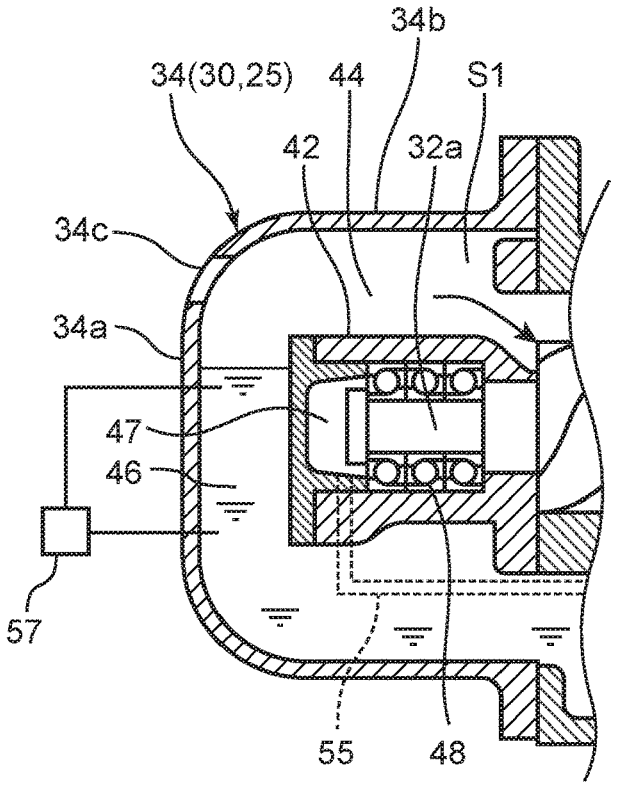
FIG. 3 is a schematic view illustrating an overall configuration of a thermal energy recovery device according to a modification of the first embodiment.

Note that, in the first embodiment, the oil detector 57 is configured to detect the accumulation degree of the oil in the upper part of the evaporator 10, however the configuration is not limited thereto. The oil detector 57 may not necessarily be arranged in the downstream space 10*e* as long as it can detect the accumulation degree of the oil in the connection space. The connection space described herein include the downstream space 10*e* in the evaporator 10 arranged on the downstream side of the heat exchanging portion 10*b* in the evaporator 10, the inflow passage 44 arranged on the upstream side of the supply port 33*b* in the expander 14, the main passage 4*a* that is communicated with the downstream space 10*e* and the inflow passage 44 to connect the evaporator 10 and the expander 14, and the oil reservoir 46 that is communicated with the connection port (the inflow port 34*c*) of the main passage 4*a* and the inflow passage 44 and positioned below the inflow passage 44 in the expander 14. Thus, the oil detector 57 may be configured to detect the accumulation degree of the oil in the oil reservoir 46 at the bottom of the first space S1 as shown in FIG. 3 instead of being arranged in the downstream space 10*e*. The oil detector 57 includes a detection end arranged at a position set by the lower limit value of the oil level and another detection end arranged at a position higher than that of the above-mentioned detection end. In this configuration, the oil accumulation condition is satisfied if the oil level detected by the oil detector 57 reaches the lower limit value. Thus, the oil return control is executed if the oil level detected by the oil detector 57 reaches the lower limit value. Then, if the oil level is detected by the upper detection end, the oil return control is switched to the thermal load control. In such a configuration, the oil return control is performed on the basis of the accumulation degree of the oil in the oil reservoir 46 in the expander 14, thus the insufficient oil supply to the oil supply part in the expander 14 can be more surely prevented. Note that the oil detector 57 may include only one detection end for detecting the lower limit value of the oil level as long as the oil return control is set to perform for a preset prescribed time.

Figure 4:
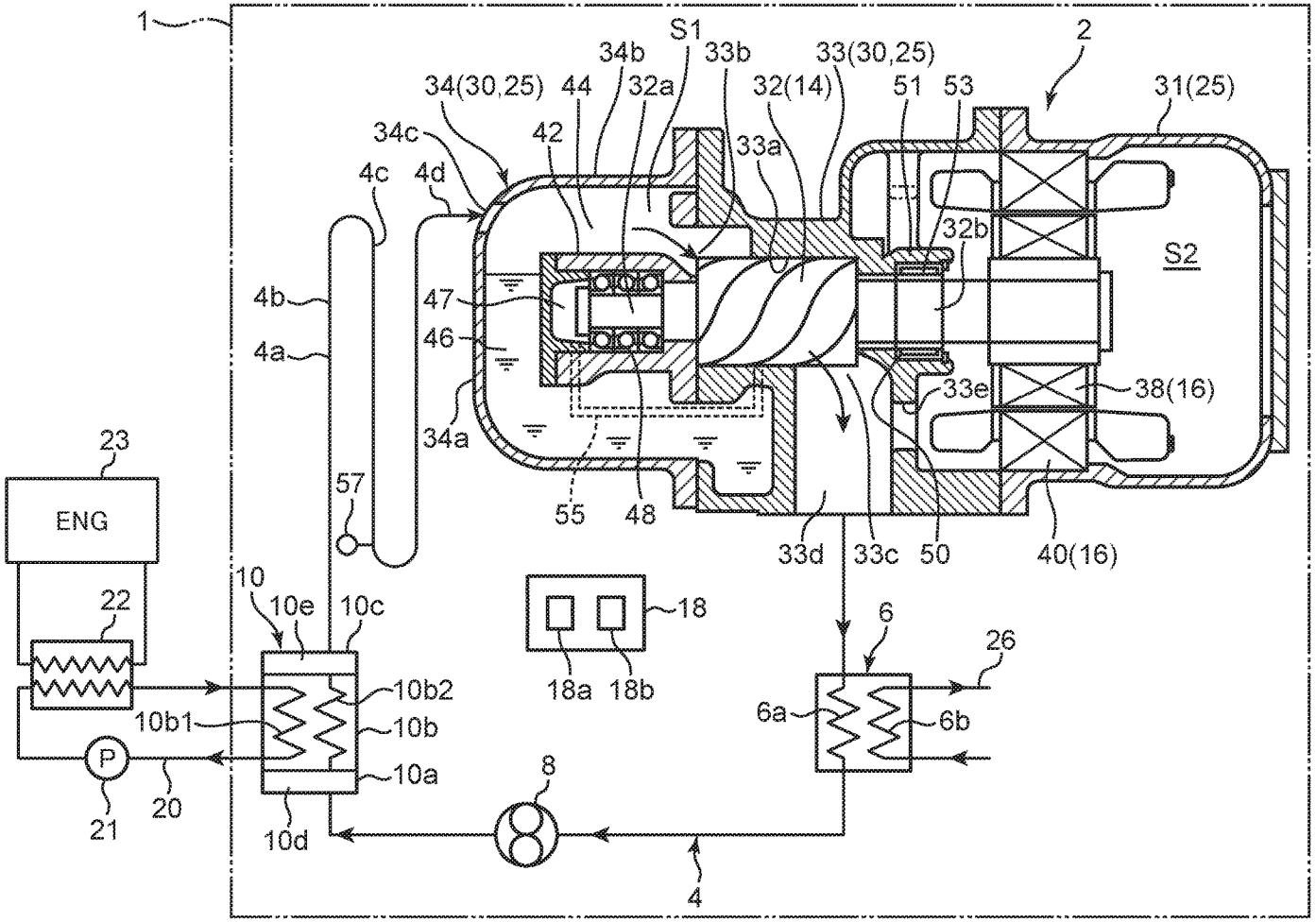
FIG. 4 is a schematic view illustrating an overall configuration of a thermal energy recovery device according to another modification of the first embodiment.

Further, as shown in FIG. 4, the oil detector 57 may be arranged in the main passage 4*a* instead of the downstream space 10*e*. Depending on the installation environment of the thermal energy recovery device 1, pipes constituting the circulation passage 4 may not be formed in a simple annular structure. For example, there may be a case where the main passage 4*a* connecting the evaporator 10 and the expander 14 includes a rising portion 4*b* extending upward from an upper part of the evaporator, a U-shaped portion 4*c* that is bent downward from an upper end of the rising portion 4*b* and then bent again into a U-shape, and a connection portion 4d connecting one upper end of the U-shaped portion 4*c* and the expander 14. In such a case, the oil may be accumulated in a bending portion in the U-shaped portion 4*c*, thus the oil detector 57 is arranged in the U-shaped portion 4*c*. If the oil detector 57 detects the oil accumulated in the U-shaped portion 4*c*, the oil return control is executed.

Figure 5:
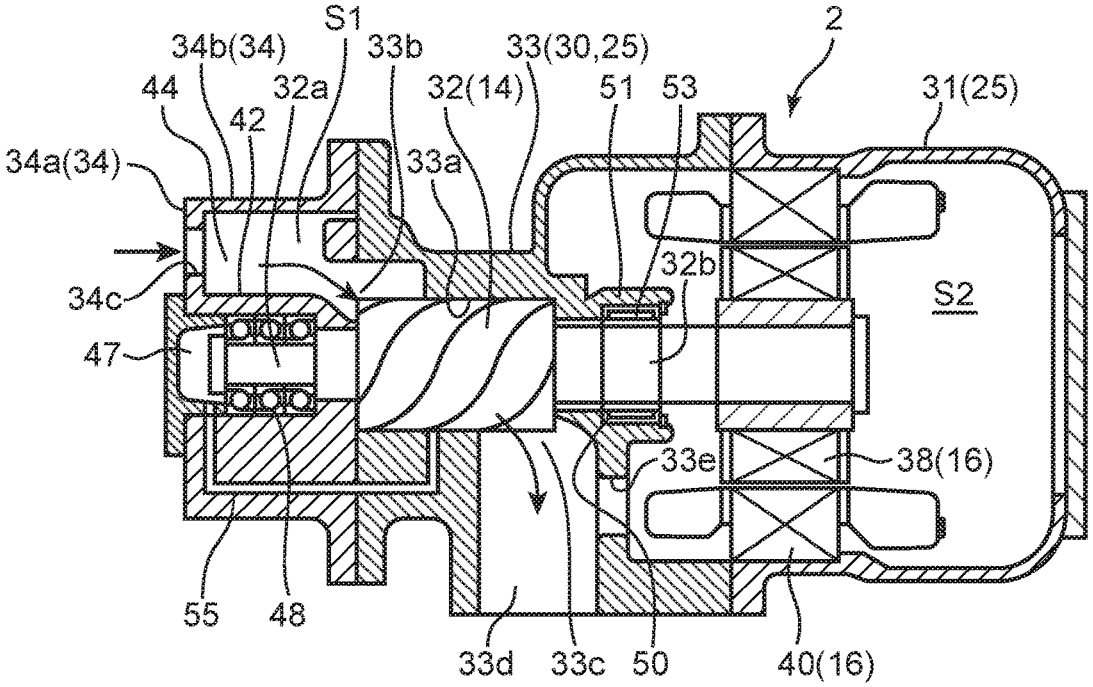
FIG. 5 is a schematic view illustrating an overall configuration of a thermal energy recovery device according to another modification of the first embodiment.

In the first embodiment, the oil reservoir 46 is formed below the inflow passage 44 in the expander 14. However, as shown in FIG. 5, the oil reservoir 46 may be omitted. In such a case, the lid portion 34 in the casing 25 is configured to couple the rotor retaining portion 33 to the first bearing retaining portion 42. The lid portion 34 includes the bottom portion 34*a* of which a lower end portion is coupled to an upper part of the first bearing retaining portion 42 and the barrel portion 34*b* that extends from an upper end and side end of the bottom portion 34*a* in the axial direction of the screw rotors 32 to be coupled to the rotor retaining portion 33. Further, the inflow passage 44 is formed between the lid portion 34 and the upper part of the first bearing retaining portion 42. The inflow passage 44 may be formed so as to extend in the axial direction of the screw rotors 32. The inflow port 34*c* is formed at the bottom portion 34*a* in the lid portion 34.

The oil passage 55 is arranged from the first bearing retaining portion 42 to the rotor retaining portion 33 so as to pass through the first bearing retaining portion 42 and the rotor retaining portion 33.

In the first embodiment, the oil accumulated in the downstream space 10*e* is carried by the working medium flowing in the main passage 4*a*. A configuration shown in FIG. 6 further includes an oil return pipe 58.

The oil return pipe 58 includes a first end portion that is connected to the downstream space 10*e* at a location below the connection portion to the main passage 4*a* and a second end portion that is connected to the inflow passage 44 in the expander 14. The oil return pipe 58 is thinner than the main passage 4*a*. The first end portion of the oil return pipe 58 is connected to the downstream side header 10*c* at a location below the connection portion of the downstream side header 10*c* to the main passage 4*a*. If the oil is accumulated in the downstream space 10*e* such that the oil level is located higher than the first end portion, the oil accumulated in the downstream space 10*e* can be returned to the inside of the first space S1 in the expander 14 via the oil return pipe 58. The oil return pipe 58 is thinner than the main passage 4*a*, thus the flow velocity of the working medium in the oil return pipe 58 is higher than that of the working medium in the main passage 4*a*. As a result, the oil in the oil return pipe 58 can be easily accompanied with the working medium.

Second Embodiment

Figure 7:
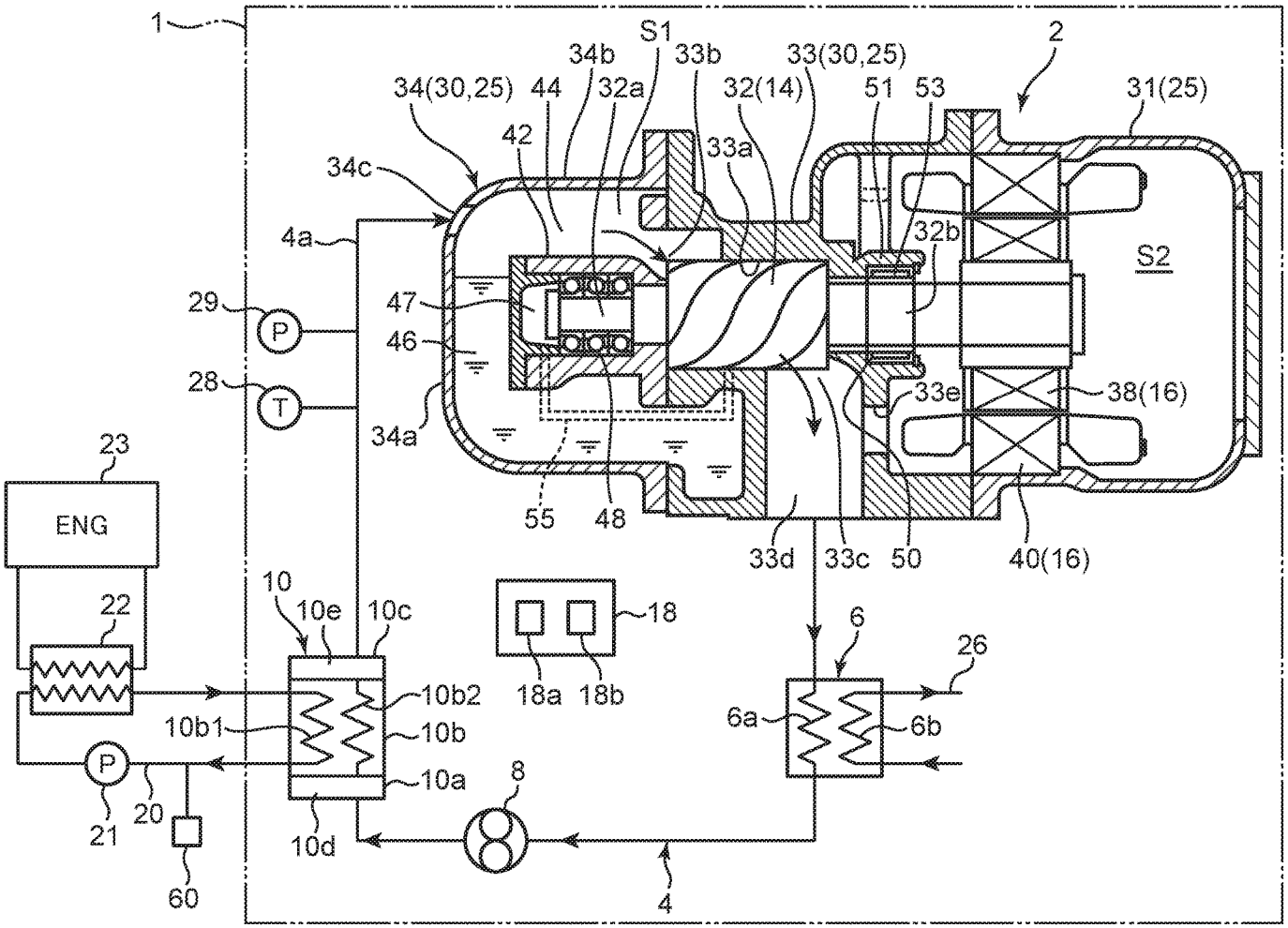
FIG. 7 is a schematic view illustrating an overall configuration of a thermal energy recovery device according to a second embodiment of the present invention.

FIG. 7 shows a second embodiment of the present invention. Note that the same structural elements as in the first embodiment are denoted with the same reference numerals, and detailed explanation of these structural elements is omitted.

The configurations shown in FIG. 1 to FIG. 5 each includes the oil detector 57 (not shown in FIG. 1 and FIG. 5). In contrast, a thermal energy recovery device 1 according to a second embodiment includes a detection means for detecting a thermal load state in the evaporator 10 instead of the oil detector 57 for detecting the accumulation degree of the oil. Further, the oil return control is executed not by the satisfaction of the oil accumulation condition, but by the satisfaction of a preset low load condition regarding a low load of a prescribed value or less in the evaporator 10. Such a low load condition is set by assuming that the oil is hardly returned from the evaporator 10 to the expander 14 if a state in which the thermal load transferred from the heating medium is low in the evaporator 10 (a partial load state) continues for a certain time.

In the second embodiment, a temperature detector 60 is provided to a heating medium passage 20 as a thermal load state detection means for directly detecting the thermal load in the evaporator 10. Then, the low load condition is satisfied if a temperature of the heating medium detected by the temperature detector 60 continues to be lower than a preset threshold for a preset time or longer.

Figure 8:
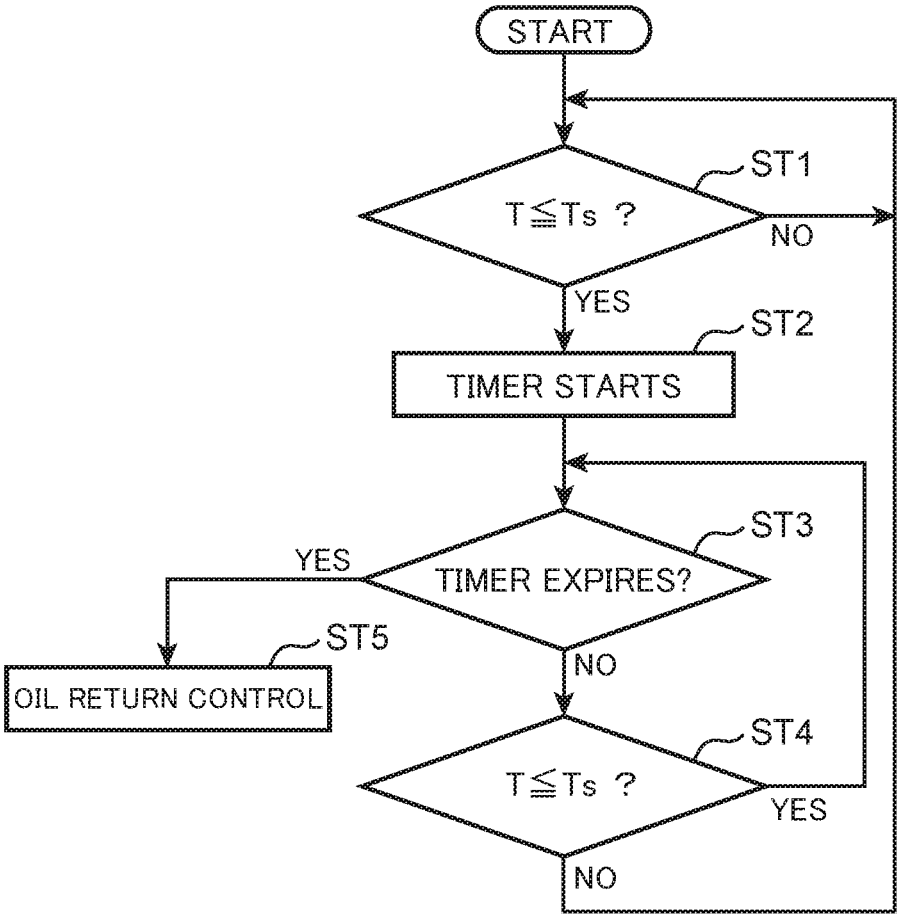
FIG. 8 is a flow chart for explaining control operations of the thermal energy recovery device.

Specifically, as shown in FIG. 8, the controller 18 determines whether a detection temperature T by the temperature detector 60 is equal to or less than a standard temperature Ts (a step ST1). If the detection temperature T is higher than the standard temperature Ts, the step ST1 is repeated. The standard temperature Ts is lower than an upper limit value in a range where the temperature of the heating medium flowing in the heating medium passage 20 changes at the time of normal operation. The standard temperature Ts can be determined by confirming in advance that the oil is likely to be accumulated when the heating medium temperature is equal to or lower than the standard temperature Ts.

If the detection temperature T becomes equal to or less than the standard temperature Ts, the process proceeds to a step ST2. In the step ST2, a timer as a time counting means in the controller 18 starts time counting. Then, until a prescribed time elapses according to the counting of the timer (a step ST3), the process proceeds to a step ST4 to determine whether the detection temperature T by the temperature detector 60 remains equal to or less than the standard temperature Ts. If the detection temperature T becomes higher than the standard temperature Ts, the process is returned to the step ST1, while if the detection temperature T remains equal to or less than the standard temperature Ts, the counting of the timer continues. Then, if the prescribed time elapses according to the counting of the timer, the process proceeds to a step ST5 in which the controller 18 switches the thermal load control to the oil return control.

Having a configuration of detecting the thermal load in the evaporator 10 in this manner enables to switch the thermal load control to the oil return control without detecting the accumulation degree of the oil. Thus, the switching to the oil return control can be surely performed by a relatively simple configuration (the detector and the software) even if a large wave is formed on the oil surface in the oil accumulation place.

Note that the thermal load state detection means is not limited to the temperature detector 60 for detecting the temperature of the heating medium, and may be a flow rate detector, not shown, for detecting a flow rate of the heating medium. In such a case, the low load condition is satisfied if the flow rate of the heating medium detected by the low rate detector continues to be lower than a preset standard flow rate for a preset time or longer.

Figure 9:
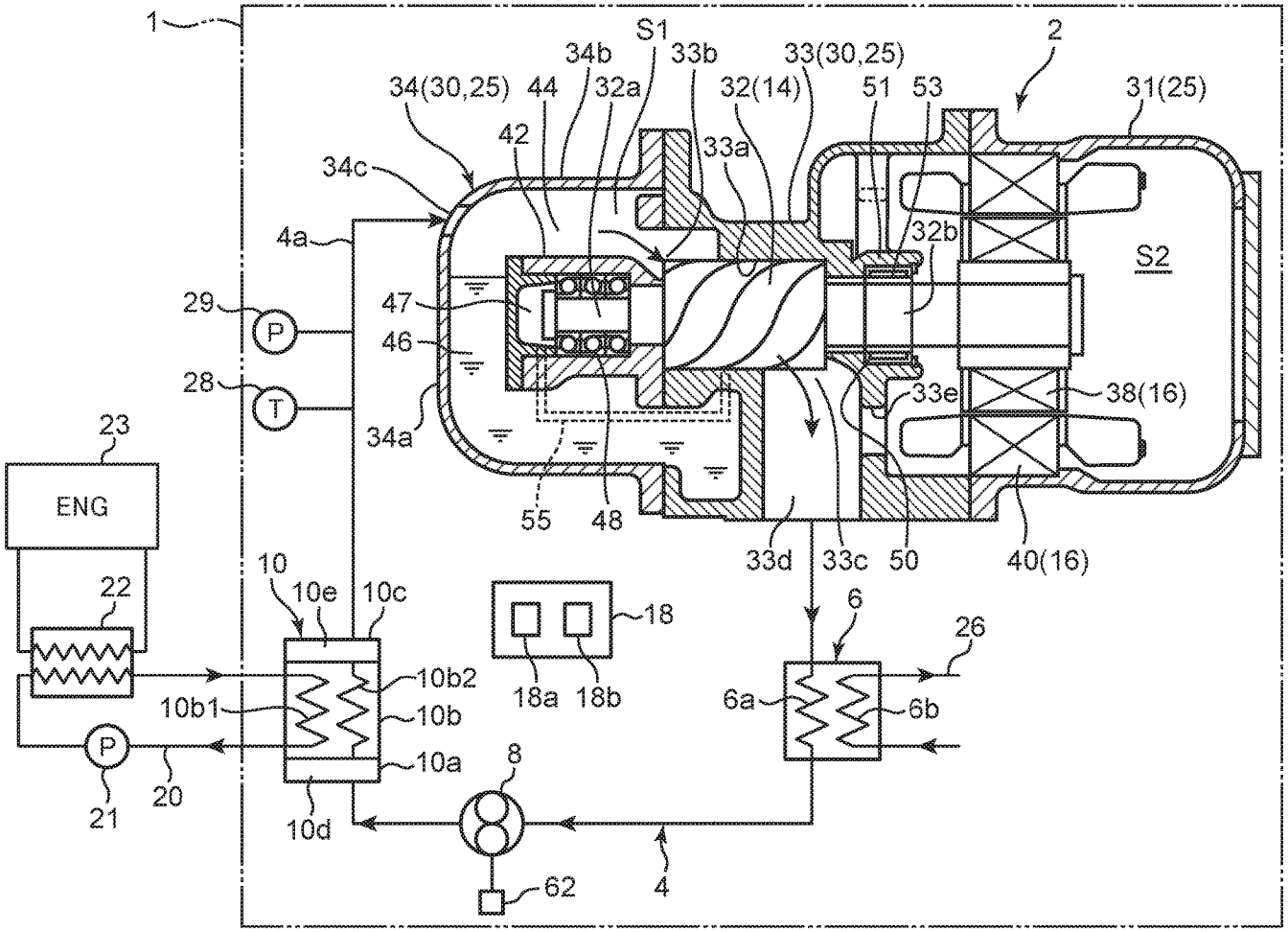
FIG. 9 is a schematic view illustrating an overall configuration of a thermal energy recovery device according to a modification of the second embodiment.

Further, the thermal load state detection means is not limited to the detector that directly detects the thermal load in the evaporator 10 and may be a detector that indirectly detects the thermal load in the evaporator 10. For example, as shown in FIG. 9, a rotational number detector 62 for detecting the rotational number of the pump 8 may be provided as the thermal load state detection means. In such a case, the low load condition is satisfied if the rotational number of the pump detected by the rotational number detector 62 continues to be lower than a preset standard rotational number for a preset time or longer.

Figure 6:
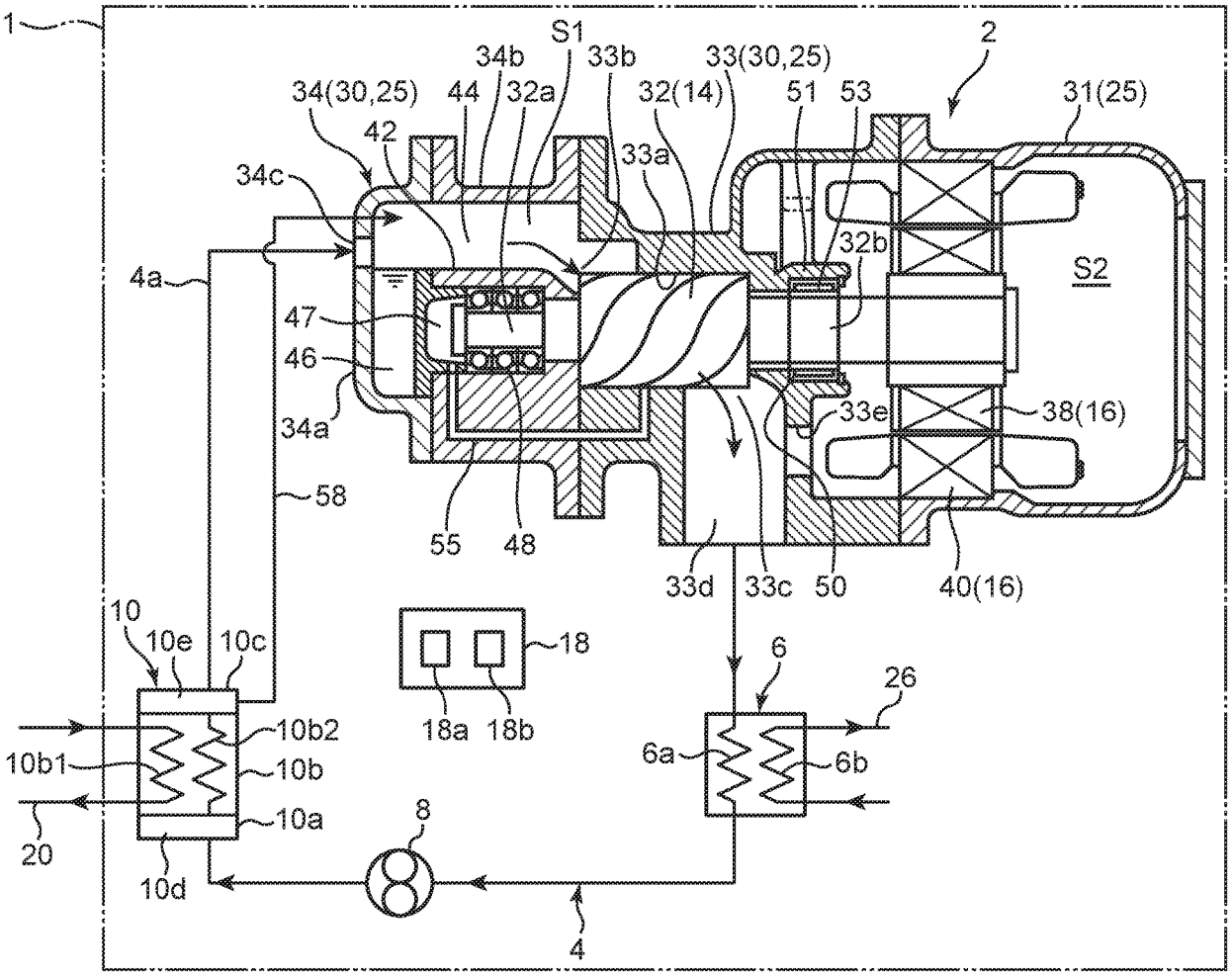
FIG. 6 is a schematic view illustrating an overall configuration of a thermal energy recovery device according to another modification of the first embodiment.

Also in the second embodiment, the oil reservoir 46 may be omitted in the expander 14 as shown in FIG. 5 or the oil return pipe 58 may be additionally provided as shown in FIG. 6.

What is claimed is:

1. A thermal energy recovery device comprising:

a circulation passage having an evaporator, an expander, a condenser, and a pump; and a controller for controlling the rotational number of the pump, the expander being driven by introduction of a mixed medium of a working medium evaporated in the evaporator and oil, wherein:

the controller can execute a thermal load control for controlling the rotational number of the pump according to a thermal load in the evaporator and an oil return control for driving the pump at the rotational number higher than the rotational number of the pump controlled by the thermal load control, and the oil return control is executed if a preset oil accumulation condition regarding an accumulation degree of the oil that is separated from the working medium evaporated in the evaporator or a preset low load condition regarding a low load of a prescribed value or less in the evaporator is satisfied.

2. The thermal energy recovery device according to claim 1, wherein:

the accumulation degree of the oil used in the oil accumulation condition is an accumulation degree of the oil in a connection space, and the connection space includes a downstream space, in the evaporator, arranged on a downstream side of a heat exchanging portion in the evaporator, an inflow passage positioned on an upstream side of a supply port in the expander, and a main passage that is communicated with the downstream space and the inflow passage to connect the evaporator and the expander.

3. The thermal energy recovery device according to claim 2, wherein the connection space includes an oil reservoir that is communicated with a connection port of the main passage and the inflow passage and positioned below the inflow passage in the expander.

4. The thermal energy recovery device according to claim 2, wherein:

the inflow passage is provided along an axial direction of the expander from the connection port of the main passage toward the supply port in the expander, and the connection space includes the oil reservoir that is communicated with the connection port of the main passage and the inflow passage and positioned below the inflow passage in the expander.

5. The thermal energy recovery device according to claim 2, comprising an oil detector for detecting the accumulation degree of the oil in the connection space, wherein the controller is configured to switch the thermal load control to the oil return control if the oil accumulation condition is satisfied on the basis of a detection result of the oil detector.

6. The thermal energy recovery device according to claim 3, comprising the oil detector for detecting the oil accumulated in the oil reservoir, wherein the controller is configured to switch the thermal load control to the oil return control if an amount of the oil accumulated in the oil reservoir detected by the oil detector becomes a prescribed level or less.

7. The thermal energy recovery device according to claim 1, comprising:

a thermal load condition detection means for directly or indirectly detecting a condition of the thermal load in the evaporator; and a timing means for counting a time for which the thermal load detected by the thermal load detection means remains a partial load of a prescribed value or less, wherein the controller is configured to switch the thermal load control to the oil return control if the time counted by the timing means reaches or exceeds a prescribed time on an assumption that the low load condition is satisfied.

8. The thermal energy recovery device according to claim 1, wherein:

an oil supply part in the expander is communicated with the supply port and an exhaust port in the expander, and a pressure in the oil supply part is between a pressure at the supply port in the expander and a pressure at the exhaust port in the expander.

9. The thermal energy recovery device according to claim 8, wherein:

the expander includes screw rotors and bearings rotatably supporting shafts of the screw rotors, and the bearings are the oil supply parts.

10. The thermal energy recovery device according to claim 1, wherein:

the evaporator includes a heat exchanging portion and a downstream space located on a downstream side of the heat exchanging portion;

the circulation passage includes a main passage that connects the evaporator and the expander, and an oil returning pipe having one end connected to the downstream space in the evaporator at a location below a connection portion to the main passage and the other end connected to the expander is provided.

11. The thermal energy recovery device according to claim 10, wherein the oil returning pipe is thinner than the main passage.

12. The thermal energy recovery device according to claim 1, wherein a primary side passage of the heat exchanging portion in the evaporator is connected to a cooling water passage in which cooling water for cooling an engine in a vehicle with engine flows.

* * * * *